United States Patent [19]

Lavigne et al.

[11] Patent Number: 4,768,597

[45] Date of Patent: Sep. 6, 1988

[54] WELL PERFORATION DEVICE

[75] Inventors: Jean C. Lavigne, Houston, Tex.; M. Bosse Platiere, Versailles; Gerard Bouguyon, Plaisir, both of France

[73] Assignee: Schlumberger Technology Corporation, Houston, Tex.

[21] Appl. No.: 391,277

[22] Filed: Jun. 23, 1982

[30] Foreign Application Priority Data

Jun. 30, 1981 [FR] France ..... 81 12860

[51] Int. Cl.[4] ..... E21B 43/16

[52] U.S. Cl. ..... 175/451; 166/55

[58] Field of Search ..... 175/4.51-4.56; 166/55, 55.1, 297; 102/313, 320, 321, 323

[56] References Cited

U.S. PATENT DOCUMENTS

| | | | |
|---|---|---|---|
| 2,833,213 | 5/1958 | Udry | 102/313 |
| 2,947,251 | 8/1960 | Jilly | 166/55 |
| 3,365,032 | 2/1967 | Schuster et al. | 166/55.1 |
| 4,153,118 | 5/1979 | Hart | 175/4.51 |
| 4,273,047 | 6/1981 | Rommer | 102/321 |

*Primary Examiner*—George A. Suchfield

*Attorney, Agent, or Firm*—John H. Bouchard

[57] ABSTRACT

The invention relates to a well perforation device comprising a support (25) and encapsulated shaped charges (26) fixed unidirectionally on this support, usually on the back side of a support bar whose front side is to be applied against the casing. Positioning rings (35, 36) are snapped onto the charges (26) at regular intervals along the support (25). These rings have a rounded external surface on which the perforation device can swivel up to a correct balanced position for which the front sides of the charges are applied against the casing (13).

8 Claims, 1 Drawing Sheet

FIG.1
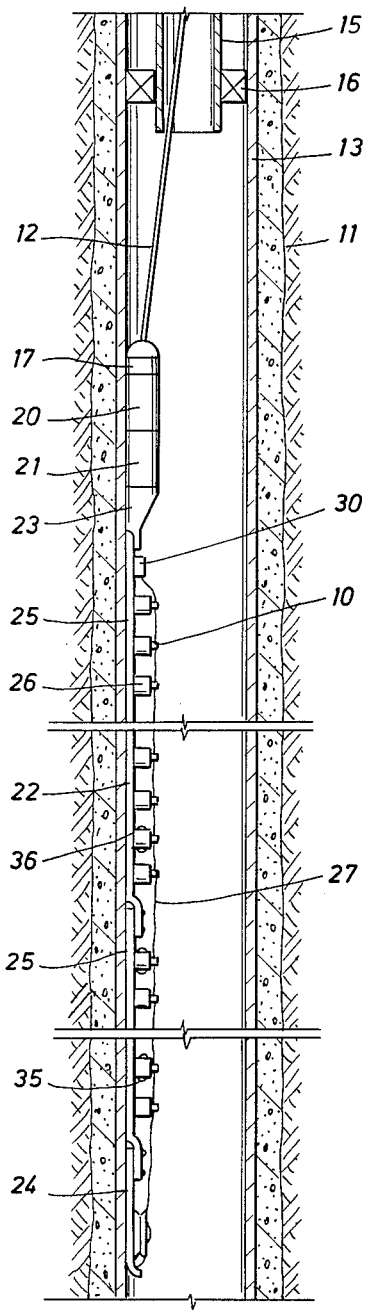
FIG.2
PRIOR ART
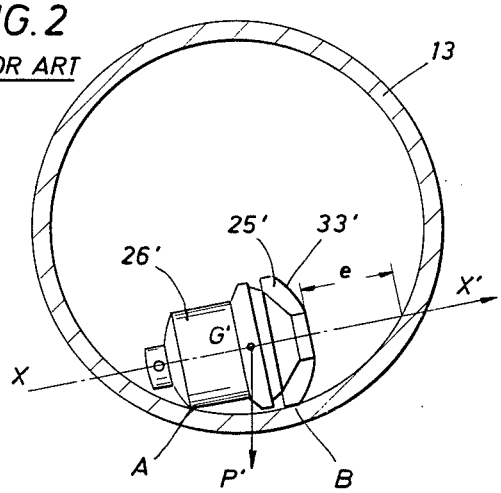
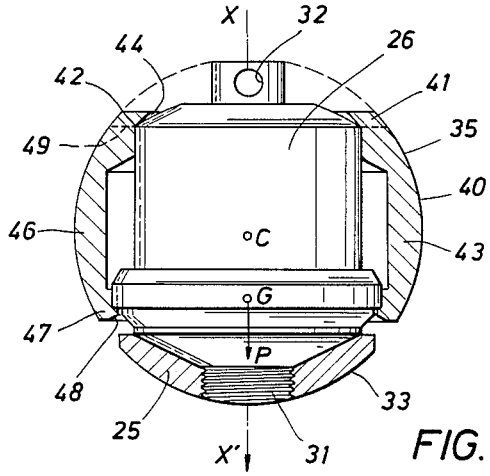
FIG. 3
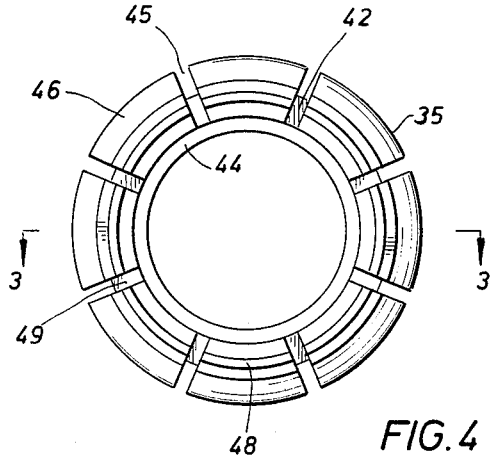
FIG. 4

WELL PERFORATION DEVICE

BACKGROUND OF THE INVENTION

The invention relates to perforation devices used in wells and more particularly to a perforation device used along a production string and including charges oriented in a single direction.

Unidirectional perforation devices capable of being lowered into wells along the production string exist in many types. One type described in U.S. Pat. No. 3,965,993 (J. Lavigne, P. Chesnel and G. Bouguyon) comprises a bar forming a support on which are fixed, by their front part, encapsulated hollow charges oriented in a single direction. The performance of such a unidirectional device is excellent provided the front side of the bar is correctly applied against a side of the casing, the center-lines of the charges being directed toward this side.

During detonation, there is then a minimum spacing between the casing and the front side of the charges, this position yielding the best perforation performance. In addition, it is in this firing position that the deformation of the bar and damage to the casing are smallest and that a maximum number of charge covers remains attached to the bar after detonation.

The perforation device described in the above U.S. Pat. No. 3,965,993 is used commercially with a magnetic positioning system placed at the head of the apparatus. This system includes permanent magnets placed on the side of the supporting bar to apply the front side of the bar against the casing. It may unfortunately occur that the force of the magnets is insufficient to apply the supporting bar correctly against the casing. This application of the bar against the casing can be incorrect if the magnets have lost their force or in the case of a large number of charges placed on a long support. The addition of another magnetic positioning system at the bottom of the support is not usually practical because the debris of the charge cases agglomerates, after firing, on this magnetic element, producing a risk of jamming when the bar and the remaining charge covers are brought back up to the surface.

Another positioning system for a perforation device of the same type is described in U.S. Pat. No. 3,858,651. Springs in the form of a safety pin drive the supporting bar of a perforator against a side of the casing while bearing on the other side. Such a system involves jamming risks in the casing or the production string. In addition, after firing, debris may accumulate on the lower spring which closes off part of the casing. This possible accumulation of debris increases the risk of jamming.

SUMMARY OF THE INVENTION

An object of the invention is therefore to provide an improved perforation device whose positioning is improved and which presents reduced jamming risks.

According to the invention, the well perforation device comprises an elongated support adapted to be moved in the well and encapsulated shaped charges fixed along the support so that their centerlines are oriented in the same direction perpendicular to the longitudinal direction of the support. At least one positioning element, fixed on a receiving charge, includes a transverse section having a rounded external profile so that the perforation device can swivel on this rounded profile around the longitudinal direction toward a balanced position for which the front side of the device is applied against a side of the borehole and the charge centerlines are directed toward this side.

The positioning element is fixed on a receiving charge located at the lower part of the support. Other identical positioning elements can be fixed on receiving charges located at predetermined intervals along the support.

Generally, magnetic means placed on a predetermined side of the device at the upper part of the support will cause the device to swivel to apply its front side against a side of the well casing. Moreover, the external profile of the positioning element is substantially circular and offcentered in relation to the center of gravity of the device so that, in deviated wells, the device swivels by gravity on this external profile toward the balanced position.

Preferably, the positioning element is a ring with a substantially spherical external surface and having elastic fingers adapted to engage by snapping or "clicking" onto the receiving charge. The fingers are made by cutting out regularly distributed radial slots in the ring. One thus obtains multiple fingers of small width which shatter into elements of small dimensions during detonation.

These positioning elements are particularly valuable in the case of devices comprising a support in the form of a bar having a front side adapted to be applied against a side of the well and a back side against which the charges are fixed from the front.

BRIEF DESCRIPTION OF THE DRAWINGS

The characteristics and advantages of the invention will appear better through the following description given as a nonlimitative example with reference to the appended drawings in which:

FIG. 1 is a view of a perforation device according to the invention shown in a well;

FIG. 2 is a cross-section showing a prior-art device having an incorrect position in a well;

FIG. 3 is a partial cross-section showing a positioning element of the invention fixed on a charge; and FIG. 4 is a front view of the positioning element of FIG. 3 taken separately.

DESCRIPTION OF THE PREFERRED EMBODIMENT

Referring to FIG. 1, a perforation device 10 is suspended in a well 11 at the end of an electric cable 12. The well 11 is equipped with a casing 13 surrounded by a cement ring 14 and a production string 15 fixed at its lower part in a packer 16. The cable 12 is wound on the surface over a winch (not shown) which makes it possible to move the device 10 along the well. In the case of such perforation operations, the cable 12 generally has a single insulated conductor connected to surface equipment (not shown) capable of furnishing electric power to fire the perforation device.

The perforation device 10 is connected to a cable head 17 comprising a conventional casing joint locator 20, a magnetic positioning system 21, and a support 22 including one or more bars 25 fixed end to end between a head 23 and a lower end piece 24.

Encapsulated shaped charges 26 are fixed at regular intervals along the inner face of the bars 25 so that their axes are oriented in the same direction perpendicular to the longitudinal direction of the bars. The magnetic positioning system 21 comprises permanent magnets placed on one side of the system to apply the external side of the bars 25 against the wall of the casing. The firing of the charges takes place by means of a detonating cord 27 which goes through a passage at the back of each charge. The upper end of the cord 27 is connected to an electric detonator 30 fixed to the bar 25. The electric conductors of the detonator 30 are connected to the head 23 to allow electric firing current to be sent into this detonator from the surface via the cable 12.

The perforation device 10 and the attachment of the charges 26 on a bar 25 are described in greater detail in the above '993 patent. As shown in FIG. 3, each charge has, at the front, a thread 31 which screws into a tapped hole of the bar 25. At the back part of each charge is provided a passage 32 for the detonating cord 27. The convex front side 33 of the bar 25 is designed to be applied against the inside of the casing.

It was seen that, under certain conditions, known perforation devices were not placed in a correct manner in the casing, notably in inclined wells, when there is a large number of charges or if the force of the magnetic positioning system is weakened. FIG. 2 illustrates such incorrect positioning, in an inclined casing 13, of a prior-art device comprising charges 26' fixed on a supporting bar 25'. The front side 33' of the bar is not applied against the casing 13 and the axis $\overline{XX}$ of the charges is not directed toward the side of the casing against which the perforation device bears. The spacing e between the front of the charges and the casing is significant and the side of the charges 26' rests on the lower part of the casing at the points A and B. The arrow P' represents the component of the weight of the perforation device in the cross section, this component being applied to the center of gravity G'. It is seen that the base AB of the device bearing on the casing is wide so that neither the component P' nor the couple due to the magnetic positioning system has the effect of swivelling the device around the longitudinal direction toward the correct firing position for which the axis $\overline{XX'}$ is directed downward. In the device of the invention, the incorrect positions are avoided because such swivelling is possible.

For this purpose, the perforation device 10 comprises at least one positioning ring 35 (FIG. 1) fixed on a receiving charge located at the lower part of the support 22. Other identical positioning rings such as 36 are fixed on receiving charges located at regular intervals along the support, for example at the bottom of each bar 25. The ring 35 is shown in greater detail in FIGS. 3 and 4.

The ring 35 is fixed by clicking it onto a receiving charge 26 after screwing the charge onto a bar 25 but before inserting the detonating cord 27. Similarly, the same conventions "front" and "back" defined in relation to the axis $\overline{XX'}$ in FIG. 2 will be used for the charge and the ring in FIGS. 3 and 4, assuming that the ring is fastened by clicking it onto the charge.

Referring to FIGS. 3 and 4, the ring 35 has a spherical external surface 40 whose center C coincides substantially with the center of curvature of the convex front side 33 of the bar 25. This ring comprises an annular back part 41 delimited outwardly by a flat surface 42 and extending toward the front by a hollowed part 43 which surrounds the charge 26. The annular part 41 of the ring has a truncated internal surface 44 which bears on a back shoulder of the charge 26. The cutting out of this annular part allows the back part of the charge to project beyond the ring, thereby leaving uncovered the passage 32 of the detonating cord.

In the hollowed part 43 are cut out eight radial slots 45 distributed regularly around the ring. These slots 45 open from the front of the ring up to flat surfaces 49 of the back annular part. These radial slots 45 together form eight fingers 46 capable of spreading elastically from the center C during clicking. The elastic fingers 46 have, at their ends, lugs 47 adapted to engage in a setback part of the cover of the charge 26. The lugs 47 havee inclined surfaces 48 which permit the introduction of the ring 35 on the receiving charge 26 by spreading the fingers 46.

If the perforation device 10 takes on an incorrect position in the borehole, similar to that of FIG. 2, the part of this device which bears against the casing is no longer formed by a wide base AB but by the rounded external profile of the positioning rings 35 and 36. The supporting base is then practically a point and a very small couple due to the magnetic system 21 is sufficient to swivel the device toward the correct position in which the front side 33 bears against a side of the casing with the axes XX' perpendicular to this side.

In a cross-section such as that of FIG. 3, the center of gravity of the device is located at a point G toward the front in relation to the center C of the external surface. In other words, the circular external profile of a ring 35 is offcentered toward the back in relation to the center of gravity G. Consequently, in a well inclined in relation to the vertical, the radial component P of the weight is sufficient by itself to cause the swivelling of the perforation device, on this circular profile, toward the balanced position indicated in FIG. 3. In fact, this force of gravity is added to the magnetic force of the positioning system 21 to bring the perforation device to the correct position.

It will be noted that the rings 35 and 36 increase only in a minimal manner the amount of debris left in the well. In fact, these rings are small in number and represent a small amount of material. These rings are made of the same steel, shattering into small elements, as that used for the charge cases. The large number of radial slots 45 provided in the ring further reduces the size of the debris.

The embodiment just described an of course allow many variants without departing from the framework of the invention. The external shape of the ring, in particular, is not necessarily spherical and it would be possible to design positioning elements having a cylindrical external shape provided that, in cross-section, i.e. perpendicular to the longitudinal direction, the external profile is rounded in a suitable manner.

What is claimed is:

1. A well perforation device comprising an elongated support adapted to be moved in the well, encapsulated shaped charges fixed along said support so that their axes are oriented in the same direction perpendicular to the longitudinal direction of said support, and at least one positioning element fixed on a receiving charge and including a cross-section having a rounded external profile so that the perforating device can swivel on said rounded profile around the longitudinal direction toward a balanced position in which the front side of the device is applied against a side of the well, the axes and said charges being directed toward this side; wherein said positioning element is a ring with a substantially circular external surface adapted to receive and engage said receiving charge.

2. The device of claim 1 wherein said positioning element is fixed on a receiving charge located at the lower part of said support.

3. The device of claim 1 further comprising other identical positioning elements fixed respectively on receiving charges located at predetermined intervals along said support.

4. The device of claim 2 or 3 further comprising magnetic means (21) placed on a predetermined side at the upper part of said support (22) to apply the front side of the device against a side of a casing installed in the well.

5. The device of claim 2 or 3 wherein said rounded external profile (40) of said positioning element (35) is substantially circular and offcentered in relation to the center of gravity (G) of the device so that, in deviated wells, the device swivels by gravity on this external profile toward the balanced position.

6. The device of claim 1 wherein said external surface is substantially spherical.

7. The device of claim 1 wherein:

(a) said support is a bar having a front side adapted to be applied against a side of the well, and a back side against which are fixed, from the front, said charges, and (b) said ring further comprises a back part having a bearing surface on the back of the receiving charge and a cutout leaving an opening for the passage of a firing cord at the back of this charge, and a hollowed part surrounding the charge and including elastic fingers having, at their front ends, internal lugs adapted to engage in a set-back part of the receiving charge to fix the ring on this charge.

8. The device of claim 7 wherein said elastic fingers are obtained by cutting out in said hollowed part regularly distributed radial slots on its periphery to obtain multiple fingers of small width adapted to shatter into elements of small size during the detonation of the charge.

* * * * *